US012716630B2

(12) United States Patent
Cluff

(10) Patent No.: US 12,716,630 B2
(45) Date of Patent: Aug. 25, 2026

(54) METHOD OF VARYING DEFROST TRIGGER FOR HEAT PUMP

(71) Applicant: Carrier Corporation, Palm Beach Gardens, FL (US)

(72) Inventor: Charles A. Cluff, Zionsville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 374 days.

(21) Appl. No.: 18/080,391

(22) Filed: Dec. 13, 2022

(65) Prior Publication Data

US 2023/0184474 A1 Jun. 15, 2023

Related U.S. Application Data

(60) Provisional application No. 63/288,896, filed on Dec. 13, 2021.

(51) Int. Cl.
*F25B 47/02* (2006.01)

(52) U.S. Cl.
CPC ..... *F25B 47/025* (2013.01); *F25B 2700/191* (2013.01); *F25B 2700/1933* (2013.01); *F25B 2700/197* (2013.01); *F25B 2700/21173* (2013.01); *F25B 2700/21174* (2013.01)

(58) Field of Classification Search
CPC ..... F25B 47/025; F25B 2700/191; F25B 2700/1933; F25B 2700/197; F25B 2700/21173; F25B 2700/21174
See application file for complete search history.

(56) References Cited

U.S. PATENT DOCUMENTS

| | | | | |
|---|---|---|---|---|
| 4,338,790 | A | 7/1982 | Saunders et al. | |
| 4,563,877 | A | 1/1986 | Harnish | |
| 5,428,966 | A * | 7/1995 | Alsenz | F25B 1/00 62/116 |
| 6,244,057 | B1 | 6/2001 | Yoshida et al. | |
| 7,716,936 | B2 | 5/2010 | Bailey et al. | |
| 9,719,715 | B2 | 8/2017 | Qu et al. | |
| 9,933,200 | B2 | 4/2018 | Qu et al. | |
| 10,018,400 | B2 | 7/2018 | Qu et al. | |
| 10,041,721 | B2 | 8/2018 | Qu et al. | |
| 10,442,272 | B2 | 10/2019 | Galansky et al. | |
| 10,533,782 | B2 | 1/2020 | Xu et al. | |
| 10,591,195 | B2 | 3/2020 | Renna | |

(Continued)

FOREIGN PATENT DOCUMENTS

| | | | |
|---|---|---|---|
| CA | 2991820 | A1 | 7/2019 |
| CN | 104930645 | A | 9/2015 |

(Continued)

OTHER PUBLICATIONS

Extended European Search Report for European Application No. 22213241.7; Report Mail Date Apr. 17, 2023 (pp. 1-8).

*Primary Examiner* — Elizabeth J Martin
(74) *Attorney, Agent, or Firm* — CANTOR COLBURN LLP

(57) ABSTRACT

A method for determining when to initiate a defrost mode of a heat pump includes monitoring a heating capacity of an evaporator of the heat pump during operation of the heat pump in a heating mode, determining a threshold associated with the heating capacity, and initiating a defrost mode when the heating capacity of the evaporator is less than or equal to the threshold.

17 Claims, 11 Drawing Sheets

(56) References Cited

U.S. PATENT DOCUMENTS

| | | | | |
|---|---|---|---|---|
| 11,047,610 | B2 | 6/2021 | Kalambe et al. | |
| 2011/0132019 | A1 | 6/2011 | Hamada et al. | |
| 2013/0086929 | A1 | 4/2013 | Senf, Jr. | |
| 2014/0090406 | A1* | 4/2014 | Ishikawa | F24F 11/30 62/82 |
| 2015/0075192 | A1 | 3/2015 | Wasa | |
| 2015/0159935 | A1* | 6/2015 | Wei | F25B 13/00 62/81 |
| 2015/0204589 | A1 | 7/2015 | Liu | |
| 2015/0292789 | A1* | 10/2015 | Takenaka | F25D 21/006 62/140 |
| 2017/0274732 | A1* | 9/2017 | Galansky | F25B 47/022 |
| 2018/0195788 | A1 | 7/2018 | Nolte | |
| 2020/0049392 | A1* | 2/2020 | Tanaka | F25B 49/02 |
| 2020/0191458 | A1 | 6/2020 | Read et al. | |
| 2021/0071890 | A1 | 3/2021 | Myhre | |
| 2022/0107123 | A1* | 4/2022 | Ishimura | F24F 11/86 |

FOREIGN PATENT DOCUMENTS

| | | | |
|---|---|---|---|
| CN | 106627044 | A | 5/2017 |
| CN | 108444140 | A | 8/2018 |
| CN | 110094931 | A | 8/2019 |
| CN | 111692707 | A | 9/2020 |
| CN | 113330262 | A | 8/2021 |
| CN | 113465272 | A | 10/2021 |
| DE | 3441912 | A1 | 5/1986 |
| EP | 1271076 | A1 | 1/2003 |
| JP | S63273750 | A | 11/1988 |
| JP | H10103818 | A | 4/1998 |
| JP | H11270936 | A | 10/1999 |
| JP | 2009109165 | A | 5/2009 |
| JP | 2009168290 | A | 7/2009 |
| JP | 2011252639 | A | 12/2011 |
| JP | 5774535 | B2 | 9/2015 |
| KR | 20210009758 | A | 1/2021 |
| WO | 2020019849 | A1 | 1/2020 |

* cited by examiner

| TEMP (°F) | COMPRESSOR SPEED | |
|---|---|---|
| | LOW | HIGH |
| 0 | 35 | 35 |
| 5 | 35 | 35 |
| 10 | 35 | 36 |
| 15 | 44 | 42 |
| 20 | 51 | 48 |
| 25 | 58 | 55 |
| 30 | 65 | 62 |
| 35 | 74 | 70 |
| 40 | 82 | 78 |
| 45 | 92 | 87 |
| 50 | 102 | 97 |
| 55 | 113 | 107 |

FIG. 8

METHOD OF VARYING DEFROST TRIGGER FOR HEAT PUMP

CROSS-REFERENCE TO RELATED APPLICATIONS

This application claims the benefit of U.S. Provisional Application No. 63/288,896 filed Dec. 13, 2021, the disclosure of which is incorporated herein by reference in its entirety.

BACKGROUND

Embodiments of the present disclosure pertain to the art of heating, ventilation, and air conditioning (HVAC) systems, and more particularly, to a defrost cycle of an HVAC system.

Heat pumps are used in a variety of settings, for example, in heating, ventilation, and air conditioning (HVAC) systems that provide a desired air temperature in a facility. Such heat pumps commonly include a compressor, evaporator, expansion device, and condenser. The heat pumps input work to the refrigerant, e.g., by driving the compressor, thereby enabling the refrigerant to move heat from a colder heat reservoir to a warmer heat sink.

Some heat pumps are provided as "split" systems, having a first heat exchanger arranged inside of the building to be conditioned and a second heat exchanger located outside of the building to be conditioned. When such a heat pump operates in a heating mode, the second heat exchanger operating as an evaporator is disposed outside the building. "Frosting" of the evaporator is a common problem seen in such heat pump split systems. Frosting is caused by moisture accumulation on the evaporator when the evaporator temperature is at or below freezing, for example, at or below 0° C. Accumulation of frost obstructs the flow of air through the evaporator and reduces heat transfer between the evaporator and the air flowing through, both of which reduce operating efficiency.

Frost may be removed by performing periodic defrost cycles. A defrost cycle typically proceeds by reversing the flow of the refrigerant in the heat pump, such that the condenser and evaporator conceptually exchange roles. The result is that the refrigerant warms the evaporator, thereby eliminating, or at least reducing, any accumulated frost.

Existing heat pumps typically perform a defrost cycle in response to a transition decision based on one or more control parameters. This transition decision is based at least partially on the cumulative running time in heating mode. However, triggering a defrost cycle based on the running time in heating mode has some disadvantages. The rate of frost accumulation can vary based on numerous conditions such as air temperature, dew point, operating temperature of the evaporator relative to dew point, rate of airflow across the evaporator heat exchanger, and size of the evaporator heat exchanger, for example.

BRIEF DESCRIPTION

According to an embodiment, a method for determining when to initiate a defrost mode of a heat pump includes monitoring a heating capacity of an evaporator of the heat pump during operation of the heat pump in a heating mode, determining a threshold associated with the heating capacity, and initiating a defrost mode when the heating capacity of the evaporator is less than or equal to the threshold.

In addition to one or more of the features described herein, or as an alternative, further embodiments monitoring the heating capacity of the evaporator further comprises monitoring at least one parameter or operating condition of the heat pump associated with the heating capacity.

In addition to one or more of the features described herein, or as an alternative, further embodiments the parameter or operating condition is a refrigerant mass flow.

In addition to one or more of the features described herein, or as an alternative, further embodiments the at least one parameter or operating condition comprises at least one of a pressure at an outlet of the evaporator, a pressure at an inlet of a compressor arranged directly downstream from the evaporator relative to a fluid flow through the heat pump in the heating mode, and a pressure between the outlet of the evaporator and the inlet of the compressor.

In addition to one or more of the features described herein, or as an alternative, further embodiments the at least one parameter or operating condition comprises at least one of a pressure at an inlet of the evaporator, a pressure at an outlet of an expansion device, the expansion device being arranged directly upstream from the evaporator relative to a fluid flow through the heat pump in the heating mode, and a pressure between an outlet of the expansion device and the inlet of the evaporator.

In addition to one or more of the features described herein, or as an alternative, further embodiments the at least one parameter or operating condition comprises a temperature at an outlet of an expansion device, the expansion device being arranged directly upstream from the evaporator relative to a fluid flow through the heat pump in the heating mode.

In addition to one or more of the features described herein, or as an alternative, further embodiments the at least one parameter or operating condition comprises a temperature of an air discharged from the evaporator.

In addition to one or more of the features described herein, or as an alternative, further embodiments determining a threshold associated with the heating capacity further comprises: identifying a reference value associated with the heating capacity and deriving the threshold from the reference value.

In addition to one or more of the features described herein, or as an alternative, further embodiments identifying the reference value further comprises measuring a parameter or operating condition of the heat pump associated with the heating capacity when the evaporator is free of frost.

In addition to one or more of the features described herein, or as an alternative, further embodiments the evaporator is free of frost at a beginning of the heating cycle.

In addition to one or more of the features described herein, or as an alternative, further embodiments identifying the reference value further comprises looking up the reference value in a table.

In addition to one or more of the features described herein, or as an alternative, further embodiments comprising adjusting the reference value to compensate for changes in one or more operating conditions of the heat pump during the heating mode.

In addition to one or more of the features described herein, or as an alternative, further embodiments determining the threshold comprises at least one of: (i) applying a percentage reduction to the reference value, and (ii) applying an offset to the reference value.

In addition to one or more of the features described herein, or as an alternative, further embodiments comprising prohibiting initiation in the defrost mode if a cumulative time of operation of a compressor of the heat pump since operation of the heat pump in the defrost mode is less than a minimum time.

In addition to one or more of the features described herein, or as an alternative, further embodiments comprising prohibiting initiation in the defrost mode for a fixed period of time once a compressor of the heat pump beings operating after being in an idle condition.

In addition to one or more of the features described herein, or as an alternative, further embodiments comprising prohibiting initiation in the defrost mode when a rate of change of the parameter or operating condition indicates transient operating conditions.

In addition to one or more of the features described herein, or as an alternative, further embodiments comprising prohibiting initiation in the defrost mode when a rate of change of the parameter or operating condition exceeds a positive threshold or falls below a negative threshold.

In addition to one or more of the features described herein, or as an alternative, further embodiments comprising prohibiting initiation in the defrost mode when a rate of change of the parameter or operating condition is between a positive threshold and a negative threshold for less than a threshold period of time after the rate of change of the parameter was either above the positive threshold or below the negative threshold.

According to an embodiment, a system for conditioning air includes a refrigeration circuit including a compressor, and expansion valve, and a heat exchanger. A controller is configured to monitor a heating capacity of the system during operation in a heating mode, determine a threshold associated with the heating capacity, and initiate operation in a defrost mode when the heating capacity of the heat exchanger is less than or equal to the threshold.

In addition to one or more of the features described herein, or as an alternative, further embodiments comprising at least one sensor operably coupled to the controller, the sensor being configured to monitor at least one parameter or operating condition of the heat pump associated with the heating capacity.

BRIEF DESCRIPTION OF THE DRAWINGS

The following descriptions should not be considered limiting in any way. With reference to the accompanying drawings, like elements are numbered alike:

FIG. 8 is a table representing a reference value based on an ambient air temperature and low and high compressor speeds according to an embodiment.

DETAILED DESCRIPTION

A detailed description of one or more embodiments of the disclosed apparatus and method are presented herein by way of exemplification and not limitation with reference to the Figures.

Figure 1:
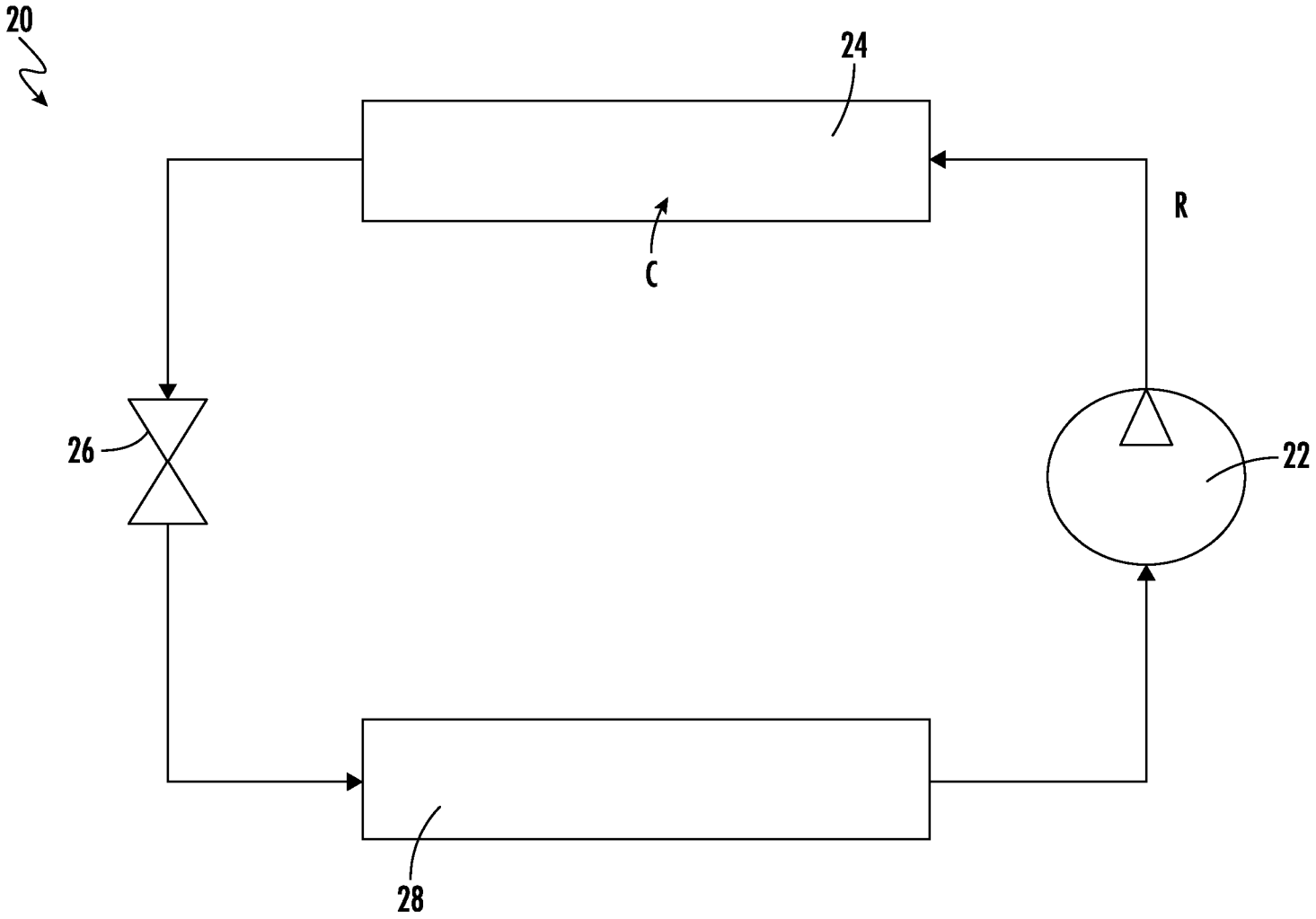
FIG. 1 is a schematic diagram of an exemplary heat pump according to an embodiment.

With reference now to FIG. 1, a schematic diagram of an example of a basic vapor compression cycle of an air conditioning system 20 is illustrated. The vapor compression cycle includes one or more compressors 22, a first heat exchanger 24, an expansion device 26, and a second heat exchanger. A fluid, such as a refrigerant for example, is configured to circulate through the vapor compression cycle, such as in a counter-clockwise direction for example.

In operation, the compressor 22 receives a refrigerant vapor from the second heat exchanger 28 and compresses it to a high temperature and pressure. The relatively hot refrigerant vapor is then delivered to the first heat exchanger 24 where it is cooled and condensed to a liquid state via heat exchange relationship with a cooling medium C, such as air or water. Accordingly, when the first heat exchanger 24 receives the refrigerant output from the compressor 22, the first heat exchanger functions as a condenser. The cooled liquid refrigerant flows from the first heat exchanger 24 to the expansion device 26, such as an expansion valve for example, in which the refrigerant is expanded to a lower pressure where the temperature is reduced and the refrigerant may exist in a two phase liquid/vapor state. From the expansion device 26, the refrigerant is provided to the second heat exchanger 28. Because heat is transferred from a secondary medium, such as air for example, to the refrigerant within the second heat exchanger 28, causing any refrigerant in the liquid phase to vaporize, the second heat exchanger 28 functions as an evaporator. From the second heat exchanger 28, the low pressure vapor refrigerant returns to the compressor 22 so that the cycle may be repeated.

In embodiments where the air conditioning system 20 is a heat pump, the flow of refrigerant within the vapor compressor cycle may be reversed. In such embodiments, the refrigerant may flow clockwise from the compressor 22 to the second heat exchanger 28, the expansion device 26, and the first heat exchanger 24 sequentially. In such instances, the refrigerant within the second heat exchanger 28 is cooled and condensed to a liquid state and the refrigerant within the first heat exchanger is heated to form a low pressure vapor. Accordingly, when operating in this reverse flow direction, the second heat exchanger 28 functions as the condenser and the first heat exchanger 24 functions as the evaporator of the vapor compression cycle.

Figure 2A:
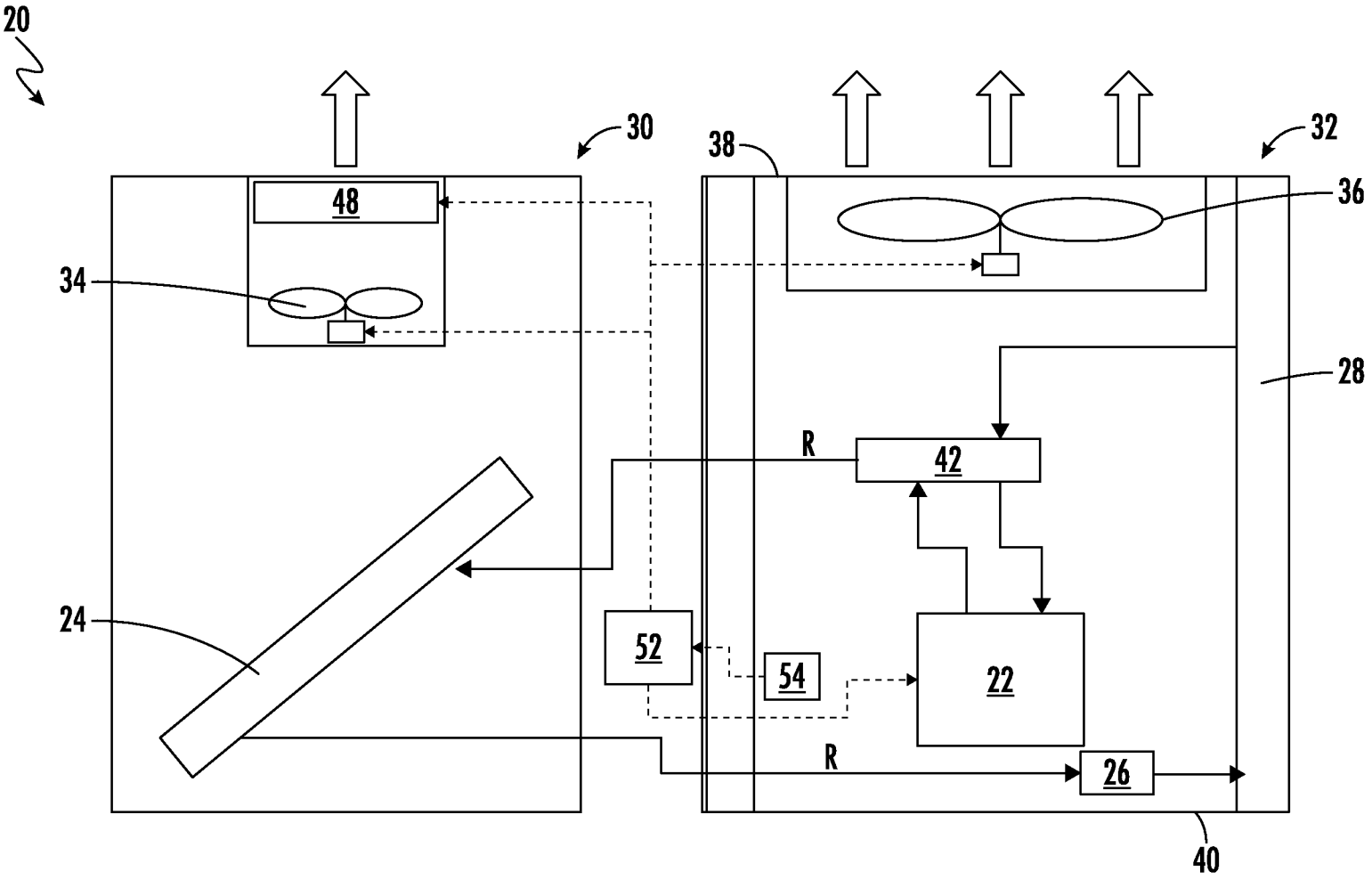
FIG. 2A is a schematic diagram of an exemplary heat pump in a first mode according to an embodiment.
Figure 2B:
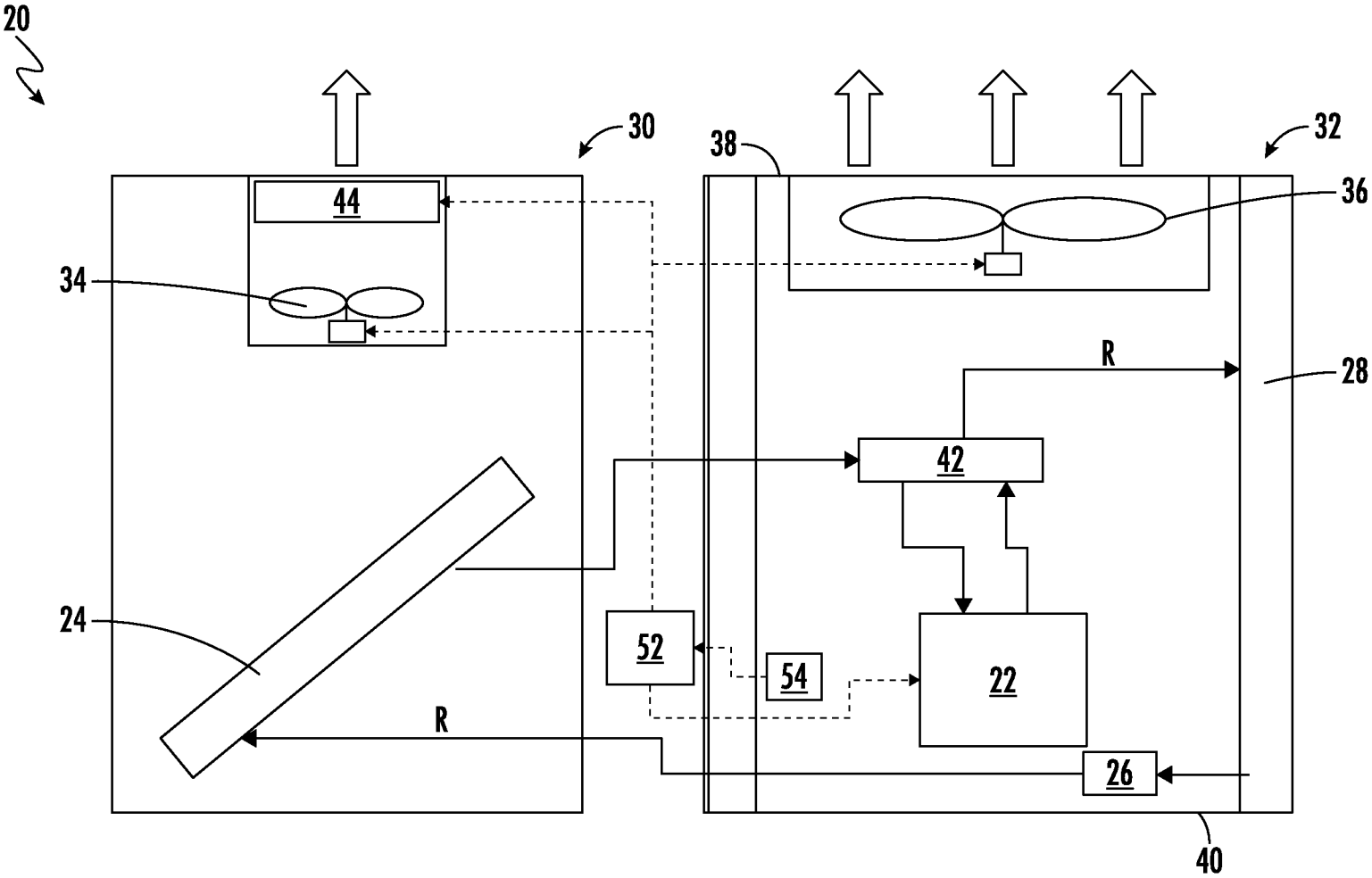
FIG. 2B is a schematic diagram of an exemplary heat pump in a second mode according to an embodiment.

With reference now to FIGS. 2A-2B, a schematic diagram of an air conditioning system, such as a heat pump for example, is shown. In the illustrated, non-limiting embodiment, the heat pump 20 includes a first or indoor portion 30 positioned inside a building to be conditioned and a second or outdoor portion 32 positioned outside of the building. It should be understood that embodiments where the heat pump 20 is installed in a single casing located partially or completely inside or outside of the building are also within the scope of the disclosure.

As shown, the at least one compressor 22 is located within the outdoor portion 32. The one or more compressors 34 may be any suitable single or multistage compressor, including, but not limited to a screw compressor, reciprocating compressor, centrifugal compressor, scroll compressor, rotary compressor or axial-flow compressor. The compressor(s) 22 may be driven by an electrically powered motor, or another suitable energy source.

The first heat exchanger 24 is also arranged within the first or indoor portion 30 and is directly or indirectly fluidly coupled to the one or more compressors 22. The first heat exchanger 24 may be any suitable type of heat exchanger configured to transfer heat between a refrigerant and air or another medium. For example, the first heat exchanger 24 may include one or more coils of thermally conductive material, such as copper, aluminum, alloys thereof, or combinations thereof. In other embodiments, the first heat exchanger 24 may be a shell- and tube heat exchanger, a printed circuit heat exchanger, a plate-fin heat exchanger, or any combination thereof. In the illustrated, non-limiting embodiment, the air or other medium is moved (drawn or blown) over the first heat exchanger 24 via a first movement mechanism 34, such as a fan for example.

The heat pump 20 includes at least one expansion device 26. Although a single expansion device 26 is illustrated, it should be understood that embodiments having a separate indoor expansion device positioned within the indoor portion and an outdoor expansion device positioned within the outdoor portion are also contemplated herein. The first heat exchanger 24 is fluidly coupled to the expansion device 26.

The second heat exchanger 28 is arranged within the second or outdoor portion 32 of the heat pump 20 and is also fluidly coupled to the expansion device 26. In embodiments including a separate indoor expansion device and outdoor expansion device 26, the first heat exchanger 24 is fluidly coupled to a first (indoor) expansion device and the second heat exchanger 28 is fluidly coupled to a second (outdoor) expansion device. In such embodiments, refrigerant is only configured to flow through one of the expansion devices in each direction of flow through the refrigeration circuit.

Similar to the first heat exchanger 24, the second heat exchanger 28 may be any suitable type of heat exchanger configured to transfer heat between a refrigerant and air or another medium. In the illustrated, non-limiting embodiment, the second heat exchanger 28 is disposed about the outer extent of the outdoor portion 32. However, embodiments where the second heat exchanger 28 is arranged at another location, such as within or proximal to the outdoor portion 32 are also contemplated herein.

The second heat exchanger 28 may have any suitable configuration. For example, the second heat exchanger 28 may include one or more coils of thermally conductive material, such as copper, aluminum, alloys thereof, or combinations thereof. In other embodiments, the second heat exchanger 28 may be a shell- and tube heat exchanger, a printed circuit heat exchanger, a plate-fin heat exchanger, or any combination thereof.

In the illustrated, non-limiting embodiment, the outdoor portion 32 includes a second movement mechanism 36, such as a fan assembly for example, to move air or another medium over the second heat exchanger 28. The second movement mechanism 36 may be arranged adjacent a top 38 of the outdoor portion 32, as shown, or may be positioned near a bottom 40 of the outdoor portion, or at any point between the top 38 and the bottom 40 to push or pull air through the outdoor portion.

The heat pump 20 additionally includes a reversing valve 42 configured to redirect the flow of refrigerant R therein. In the illustrated embodiment, the reversing valve 42 is arranged within the outdoor portion 32 and includes a fluidly separate first flow path and second flow path. In a first state, as shown in FIG. 2A, the first flow path fluidly connects an outlet of the one or more compressors 22 to the first heat exchanger 24, and the second flow path fluidly connects the second heat exchanger 28 to an inlet of the one or more compressors 22. In a second state, the first flow path fluid connects the outlet of the one or more compressors 22 to the second heat exchanger 28 and the second flow path fluidly connects the first heat exchanger 24 to the inlet of the one or more compressors 22 (FIG. 2B). It should be understood that the heat pump 20 illustrated and described herein is intended as an example only and that a heat pump having another configuration and/or additional components arranged along the fluid flow path are also within the scope of the disclosure.

During normal operation of the heat pump 20, the heat pump is operable in a "heating" mode (FIG. 2A). When the reversing valve 42 is in the first state, refrigerant is configured to flow through the closed refrigeration circuit from the compressor 22 to the first heat exchanger 24 acting as a condenser. Within the first heat exchanger 24, heat is transferred from the refrigerant to the air moving across the first heat exchanger 24 by the first movement mechanism 34. This warmed air may be used to heat one or more areas to be conditioned within the building. The partially or fully condensed liquid refrigerant is provided from the first heat exchanger 24 to the expansion device 26 where the pressure is reduced causing the refrigerant to be expanded and cooled to a temperature below the ambient temperature. Within the second heat exchanger 28, heat is transferred to the refrigerant from the air moving across the second heat exchanger 28 by the second movement mechanism 36. This heat causes the liquid portions of the refrigerant to evaporate to a gaseous phase. From the second heat exchanger 28, the refrigerant is returned to the compressor 22 via the reversing valve 42.

During normal operation of the heat pump 20, frost can accumulate on the second heat exchanger 28. When frost accumulates on the second heat exchanger 28, the frost impedes heat transfer from the air to the heat exchanger and therefore provides undesirable insulating properties to the heat exchanger. The undesirable insulating properties result in an increase in the temperature difference between the temperature of the air and the temperature of the heat exchanger. As the extent and thickness of frost increases, the degree of insulating properties of the frost increases. Accordingly, the temperature of the second heat exchanger 28 will continue to decrease indefinitely as frost continues to accumulate.

As frost accumulates on the second heat exchanger 28 and the operating temperature of the second heat exchanger 28 decreases, the operating temperature of the refrigerant within the second heat exchanger 28 decreases as a result. Given a fixed amount of superheat, the density of the refrigerant vapor leaving the second heat exchanger 28 decreases as the temperature of the vapor decreases. Decreasing vapor density for a given volume flow results in decreasing mass flow, and the heating capacity of the refrigerant system decreases. Therefore, the extent and thickness of the presence of frost will directly relate to a decrease in mass flow and heating capacity.

To eliminate, or at least mitigate, this frost, the heat pump 20 may transition to a defrost mode, such as by switching the reversing valve 42 to the second state. In the second state, shown in FIG. 2B the direction of flow of refrigerant through the closed refrigerant circuit is reversed. Accordingly, the warm, high pressure refrigerant output from the at least one compressor 22 is routed to the second heat exchanger 28 such that the second heat exchanger 28 functions as a condenser rather than as an evaporator. In the defrost mode, the second movement mechanism 36 may be disabled to prevent air movement through the second heat exchanger 28 thus enabling the temperature of the second heat exchanger 28 to increase. From the second heat exchanger 28, the refrigerant is expanded in an expansion device 26, such as the indoor expansion device (not shown), and then is delivered to the first heat exchanger 24, which is configured to operate as an evaporator. Within the first heat exchanger 24, the refrigerant can absorb heat from the medium moving across the first heat exchanger 24 via the first movement mechanism 34. In an embodiment, the heat pump 20 includes an auxiliary heater 44 configured to heat the cool air output from the first heat exchanger 24 during a defrost cycle to meet the heating demands of the area being conditioned. From the first heat exchanger 24, the refrigerant is returned to the compressor 22 via the reversing valve 42.

As previously noted, existing heat pumps 20 typically transition between a heating mode in which the reversing valve 42 is in the first state and a defrost mode in which the reversing valve 42 is in the second state in response to the running time of the heat pump in a heating mode. The process of determining when to transition between the heating mode and the defrost mode can be improved in several ways. In an embodiment, the run time of the heating mode run is configured during equipment installation based on local climate and characteristics of the particular installation (i.e. proximity to sources of moisture, etc.). This configuration may be performed by making adjustments to an equipment control board.

Alternatively, or in addition, the run time of the heating mode can be optimized by monitoring the heating capacity of the second heat exchanger during a heating cycle. A comparison of the heating capacity of the second heat exchanger during operation of the heating cycle and the heating capacity of the second heat exchanger when no frost is present will indicate the reduction in heating capacity due to frost accumulation on the second heat exchanger.

Several parameters of the heat pump can be used to observe a reduction in heating capacity. Heating capacity relates directly to refrigerant mass flow and occurs primarily with refrigerant phase change (i.e. when it condenses into a liquid or evaporates into a vapor). The amount of heat being absorbed or rejected is determined primarily by the mass of refrigerant changing phase. In a closed loop system with a continuous flow of refrigerant, the mass of refrigerant changing phase is indicated by the mass flow rate of refrigerant in the system. Further, under steady state conditions, the mass flow rate is the same at any point in the closed loop system. Therefore, mass flow measured at any point in the loop will provide the same result.

Mass flow can be determined at numerous locations within the refrigerant loop by determining the characteristics of the refrigerant such as temperature, pressure, and phase of the refrigerant at one or several measurement points. For example, mass flow can be determined between the outlet of the second heat exchanger 28 and the suction inlet to the one or more compressors 22. Mass flow into the one or more compressors 22 can be indicated by the volume flow (e.g. cubic centimeters per second) into each compressor 22 and the density of the refrigerant vapor (e.g. grams per cubic centimeter) at the suction inlet to each of the one or more compressors 22. In some systems, the density of the refrigerant vapor at the outlet of the second heat exchanger 28 will indicate the density of the vapor at the inlet to the one or more compressors 22. In another example, mass flow can be determined at the expansion valve 26 using the valve opening size and the temperature and/or pressure of the refrigerant at the inlet and outlet of the expansion valve 26.

Volume flow of a compressor 22 is the product of compressor operating speed (e.g. cycles or revolutions per second) and the volume of vapor that the compressor 22 receives at the inlet and pumps during each cycle. The volume that the compressor 22 pumps is known as the compressor displacement (e.g. cubic centimeters per cycle or revolution). Compressor displacement may be fixed or variable. Compressor speed may be fixed or variable. Volume flow is therefore determined by the sum of the volume flow of each of the one or more compressors 22 in the heat pump 20.

Vapor density of the refrigerant can be determined by measuring the pressure and temperature of the refrigerant at the suction inlet to each of the one or more compressors 22. Vapor superheat may be known or assumed within a certain range due to some control mechanism such as a thermostatic expansion valve 26. When the superheat of the vapor is known, measuring only one of refrigerant temperature or pressure will allow the other parameter to be known (i.e. refrigerant temperature can be determined from refrigerant pressure and superheat, and refrigerant pressure can be determined from refrigerant temperature and superheat). Therefore, measuring only one of either pressure or temperature when superheat is known is sufficient for determining vapor density.

Figure 3:
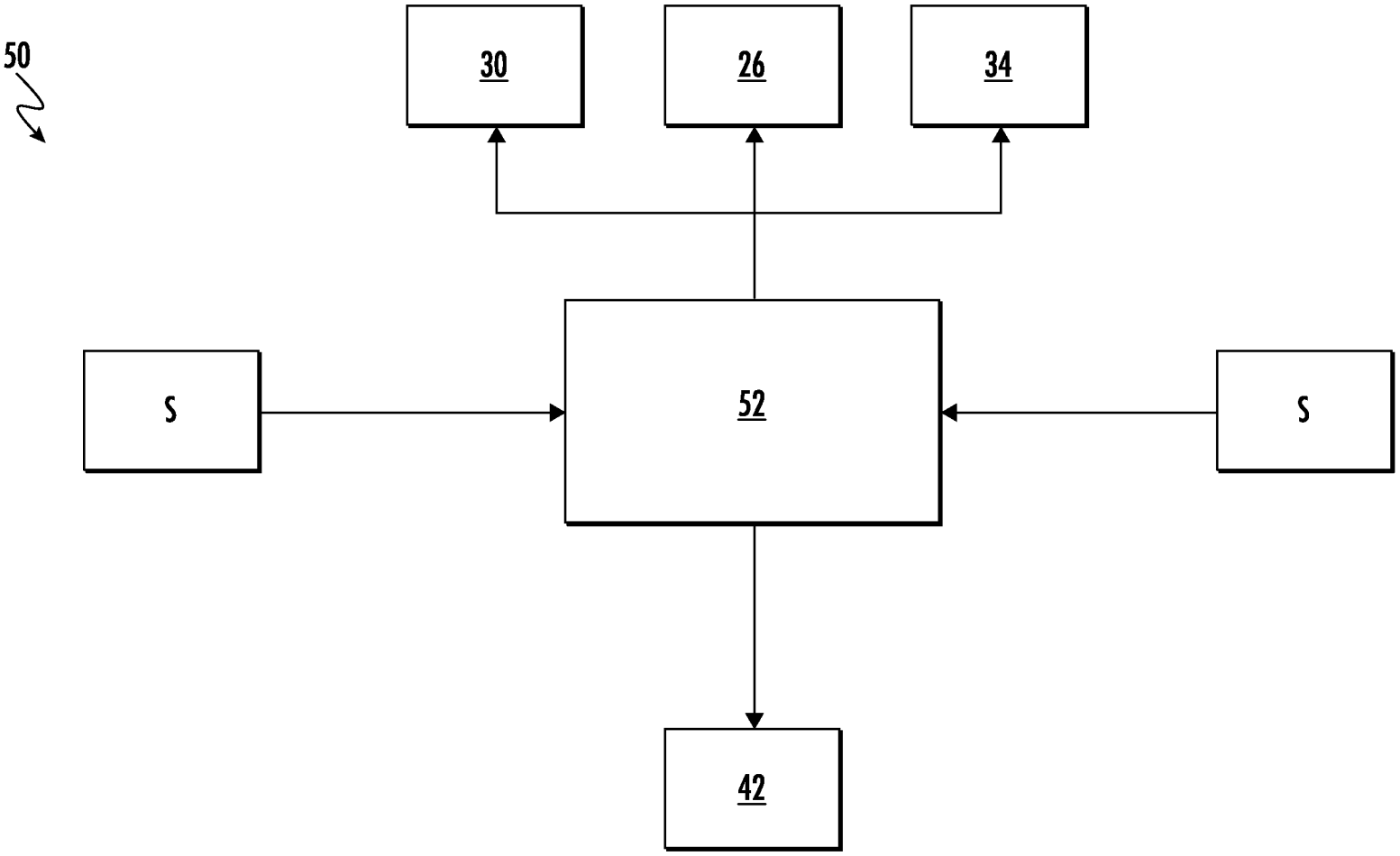
FIG. 3 is a schematic diagram of a control system of a heat pump according to an embodiment.

In an embodiment, the heat pump 20 includes a control system 50 configured to monitor one or more operating conditions of the heat pump 20 during the heating mode. With reference to FIG. 3, the control system 50 of the heat pump 20 includes a controller 52 having one or more of a microprocessor, microcontroller, application specific integrated circuit (ASIC), or any other form of electronic controller known in the art. The controller 52 is operably coupled to the compressor 22, the first and second movement mechanisms 34, 36, the reversing valve 42, and any other suitable components. In an embodiment, the control system 50 additionally includes at least one sensor S operable to monitor one or more operating parameters or operating conditions (referred to collectively herein as parameters) of the heat pump 20 that correlate to or are associated with determining the heating capacity of the second heat exchanger. The at least one sensor S may be configured to continuously monitor and communicate a respective parameter to the controller, or alternatively, may be configured to intermittently monitor and communicate a respective parameter to the controller 52.

The at least one sensor S of the control system 50 may include a temperature sensor, such as mounted within the outdoor portion 32 for example, and operable to sense an ambient temperature surrounding the outdoor portion 32. In another embodiment, the at least one sensor S is configured to monitor a temperature of the discharge air output from the second heat exchanger 28. In embodiments where the at least one sensor S includes a temperature sensor, the temperature sensor may be any suitable device, including but not limited to a thermistor, thermocouple, thermostat, infrared sensor, etc. Alternatively, the at least one sensor may be a pressure sensor consisting of any suitable device, including but not limited to a strain gage bridge, for example.

In an embodiment, the at least one sensor S includes a sensor configured to monitor one or more parameters of the refrigeration circuit of the heat pump 20. The at least one sensor may include a pressure sensor arranged at least one of within a suction line connected to the inlet of the compressor 22, at or downstream from an outlet of the expansion device 26, and at or upstream from an inlet of the second heat exchanger 28.

Alternatively, or in addition, the at least one sensor S includes a sensor configured to measure a temperature of the refrigerant, such as at a location near an outlet of the expansion valve 26. The temperature of the refrigerant may be determined by measuring the temperature of the refrigerant itself, or alternatively, by measuring a temperature of a conduit containing the refrigerant, which is configured to be representative of or substantially equal to the temperature of the refrigerant contained therein. In another embodiment, the at least one sensor S includes a mass flow sensor.

Figure 4:
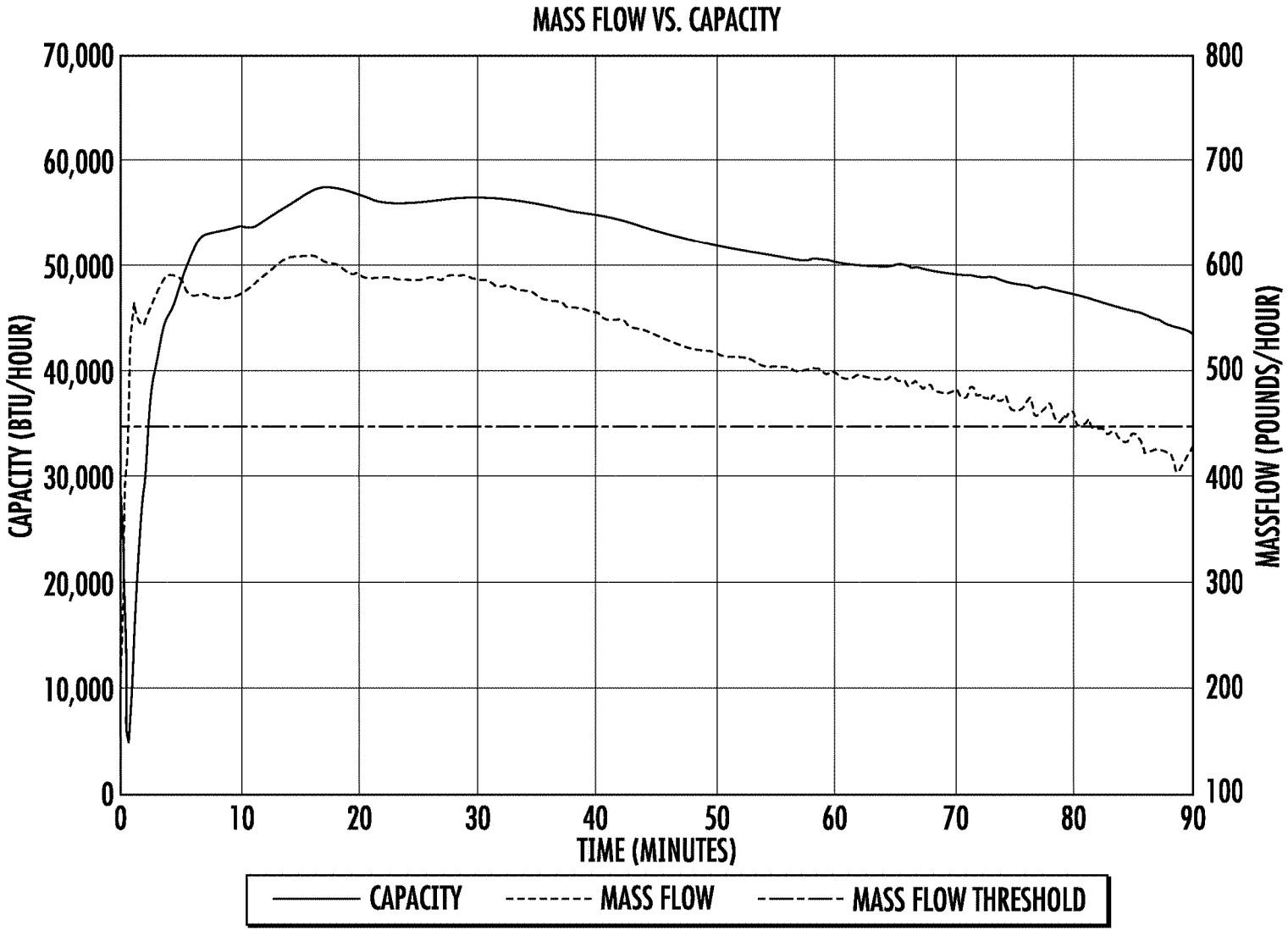
FIG. 4 is a graph comparing mass flow and heating capacity of the evaporator during operation in a heating mode according to an embodiment.

A reduction in heating capacity due to frost accumulation may be detected by monitoring the refrigerant mass flow in the heat pump 20 (see FIG. 4). The refrigerant mass flow, such as at the inlet of the compressor 22 for example, may be measured indirectly or directly via the at least one sensor S. The type of information collected by the at least one sensor S to determine or calculate the mass flow may vary based on the location at which the mass flow is being determined. Alternatively, a reduction in heating capacity can be detected by monitoring another parameter or operating condition indicative of a reduced mass flow within the refrigerant loop.

Figure 5:
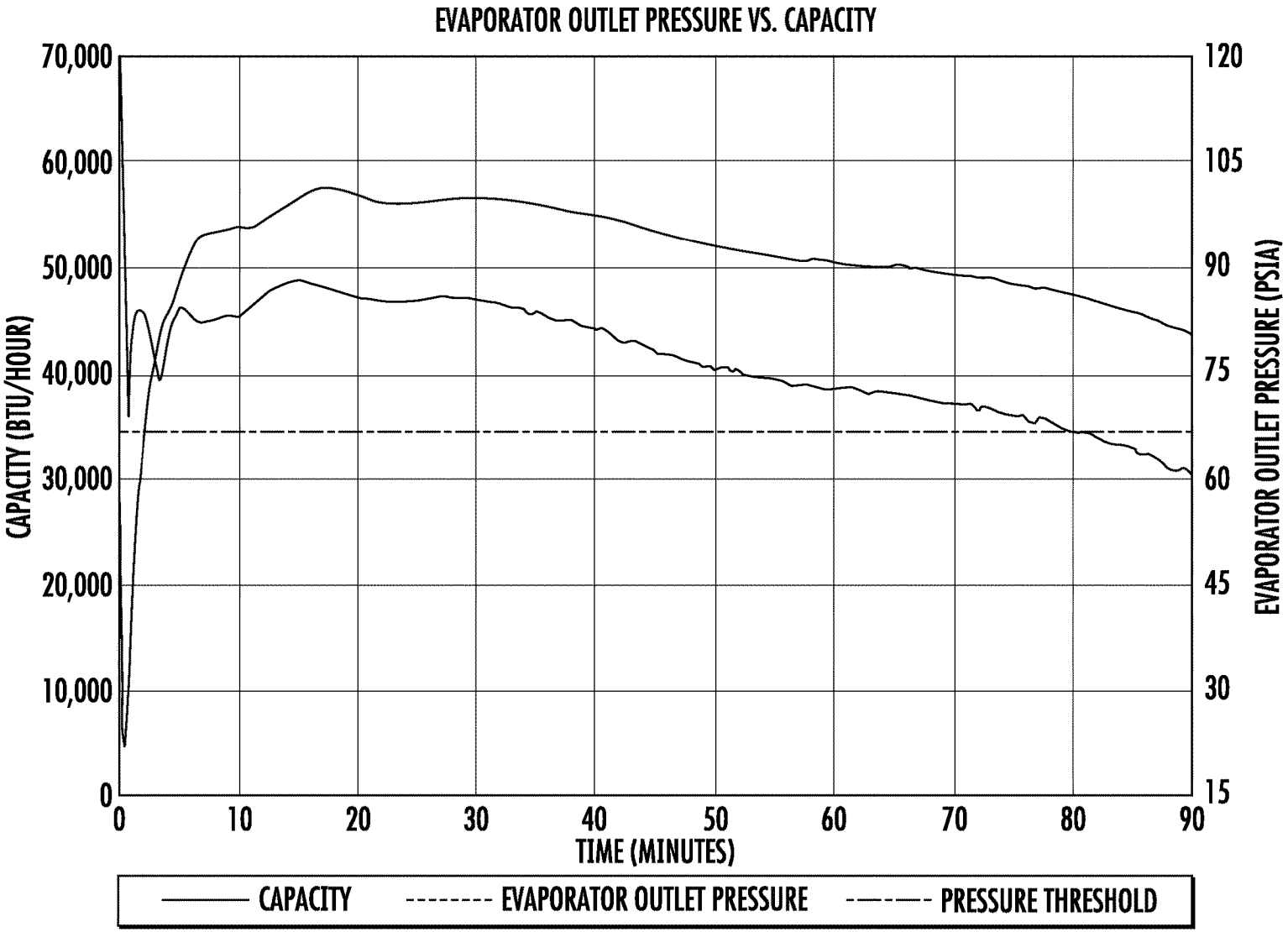
FIG. 5 is a graph comparing evaporator outlet pressure and heating capacity of the evaporator during operation in a heating mode according to an embodiment.

In an embodiment, a reduced heating capacity of the heat pump 20 can be detected by observing a reduction of some other operating parameter indicative of a reduced heat transfer to the second heat exchanger. Accordingly, a reduction in heating capacity due to frost accumulation may be detected by monitoring a reduction in pressure of the refrigerant. In an embodiment, the at least one sensor S includes a pressure sensor configured to monitor one or more of a pressure at an outlet of the second heat exchanger 28, a pressure at an inlet of the compressor 22, or a pressure at any location between the outlet of the second heat exchanger 28 and the inlet of the compressor 22 (see FIG. 5). Alternatively, or in addition, a pressure sensor may be arranged to measure a pressure at the outlet of the expansion valve 26, the pressure at the inlet of the second heat exchanger 28, or a pressure at any location between the outlet of the expansion valve 26 and the inlet of the second heat exchanger 28. The pressure and/or temperature conditions at the outlet of the expansion valve 26 are substantially identical to the conditions at the inlet of the second heat exchanger 28. Further, known characteristics of the second heat exchanger 28 for a given volume flow and vapor density will indicate the pressure difference between the inlet and the outlet of the second heat exchanger 28, and therefore can be used to correlate the pressure between the outlet of the expansion valve 26 and the inlet of the second heat exchanger 28 with the pressure at the outlet of the second heat exchanger 28.

Figure 6:
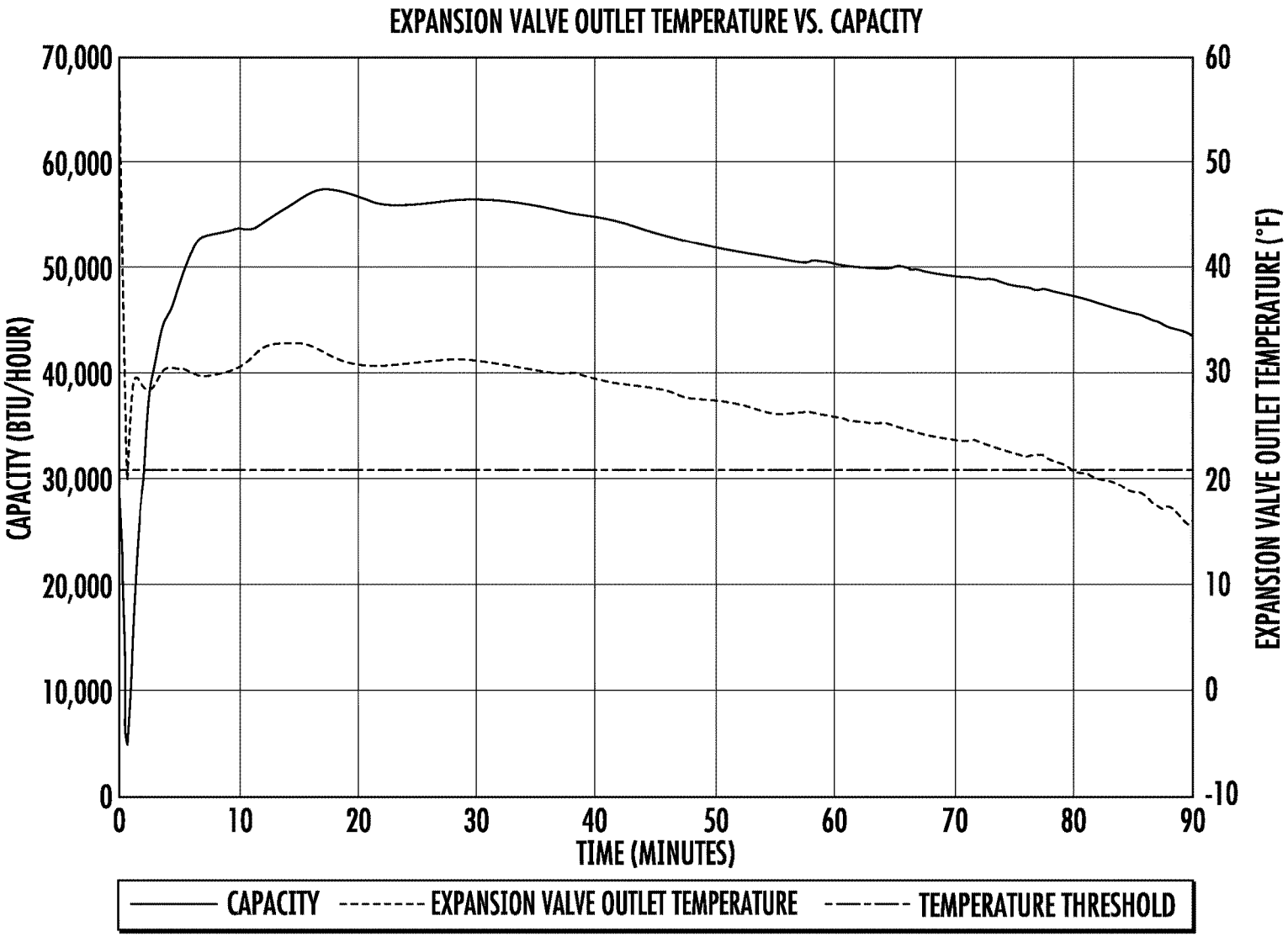
FIG. 6 is a graph comparing temperature at an outlet of an expansion valve and heating capacity of the evaporator during operation in a heating mode according to an embodiment.
Figure 7:
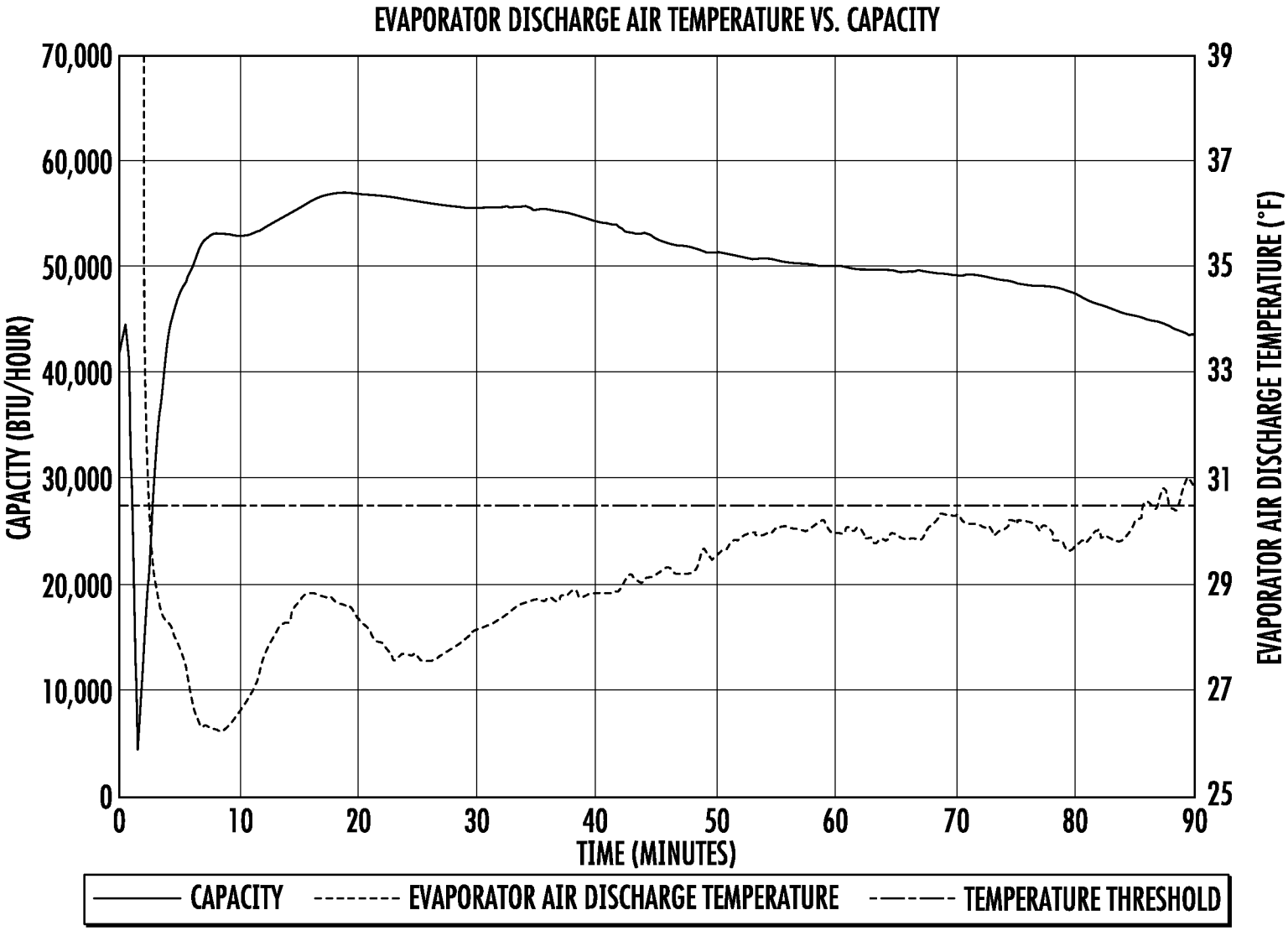
FIG. 7 is a graph comparing the temperature of the discharge air at the evaporator and heating capacity of the evaporator during operation in a heating mode according to an embodiment.

In an embodiment, a reduction in heating capacity due to frost accumulation is detected by monitoring the temperature of the refrigerant at the outlet of the expansion valve 26 (see FIG. 6). Because the refrigerant at the outlet of the expansion valve 26 is a saturated mixture of liquid and vapor, the temperature thereof will correlate to the pressure of the fluid. Alternatively, or in addition, a reduction in heating capacity due to frost accumulation may be detected by monitoring the temperature of the air discharged from the second heat exchanger 28 (see FIG. 7). As previously noted, as frost accumulates on the second heat exchanger 28, the efficiency of the second heat exchanger decreases, resulting in less heat transfer from the air to the refrigerant within the second heat exchanger 28. Accordingly, an increase in the temperature of the discharge air may be used to indicate the accumulation of frost on the second heat exchanger 28.

In each of the embodiments described herein, the controller 52 is configured to compare the monitored parameter with a respective threshold to determine when to initiate or trigger operation in the defrost mode. As used herein, the term "monitored parameter" is intended to include parameters or operating conditions that are measured via one or more sensors, or alternatively, parameter or operating conditions that are calculated using the monitored parameters or operating conditions. In an embodiment, the controller 52 is configured to transition the heat pump 20 from the heating mode to the defrost mode automatically in response to the monitored parameter crossing the threshold. In another embodiment, the defrost mode is initiated when the monitored parameter crosses the threshold and remains over the threshold for a minimum period of time. Examples of a minimum period of time include anywhere from about zero minutes to about ten minutes. The minimum period of time may vary based on the parameter, such as pressure or temperature for example.

Alternatively, or in addition, the controller 52 is configured to transition the heat pump 20 from the heating mode to the defrost mode based on a net period of time that the monitored parameter crosses the threshold and remains over the threshold. The net period of time may be calculated by an accumulated time parameter that increases when the monitored parameter exceeds the threshold indicating the need for a defrost, and decreases when the monitored parameter does not exceed the threshold indicating the need for a defrost. The net period of time may be limited from obtaining negative values when the cumulative time where the monitored parameter is less than the threshold exceeds the cumulative amount of time where the monitored parameter exceeds the threshold. The threshold for the net period of time may be anywhere from about zero minutes to about ten minutes.

The controller 52 is configured to determine the threshold for initiating operation of the heat pump 20 in the defrost mode associated with the monitored parameter. In an embodiment, the threshold for the monitored parameter is derived from a reference value of the same parameter associated with operation of the second heat exchanger 28 at the same conditions, but when no frost is present. The reference value of the parameter may be determined by measurement or calculation of that parameter in conditions where the second heat exchanger 28 is free of frost. The second heat exchanger 28 may be considered free or substantially free from frost in the first few minutes of a heating cycle following a defrost cycle. The second heat exchanger 28 may be considered free or substantially free of frost after having operated in a mode where the second heat exchanger 28 was previously operating as a condenser at temperatures known to be above freezing. Alternatively, or in addition, the second heat exchanger 28 may be considered to be free or substantially free from frost after being non-operational for a sufficient period of time while an ambient air temperature was above freezing such that any previously existing frost melted.

In another embodiment, the reference value of the parameter may be determined by observing the parameter within a period of time near the beginning of the heating cycle. The measurement time period may begin anywhere from about zero to about twenty minutes after the beginning of the heating cycle, such as between about two minutes and about five minutes for example. The duration of the measurement time period may be anywhere from about zero to about ten minutes in duration, such as between about one and about three minutes for example. A time duration of zero minutes indicates a measurement that is taken at a single point in time. The reference value of the parameter may be determined by an average value of the parameter within the measurement time period, the maximum value of the parameter within the measurement time period, or some other arithmetic calculation such as the maximum output of a filtered value of the parameter during the measurement time period.

In yet another embodiment, the reference value of the parameter may be determined without taking direct measurements. For a given set of conditions such as ambient temperature, vapor volume flow and air flow across the second heat exchanger 28, the reference value of the parameter will be repeatable within a small margin of error from one cycle to the next. Such reference values may be determined by measuring the characteristics in various combinations of operating conditions and storing values of the reference parameter relating to those operating conditions in a manner that is accessible to the controller 52. An example of a table indicating a reference value based on both the speed of the compressor 22 and the ambient air temperature is illustrated in FIG. 8. In the illustrated, non-limiting embodiment, the speed of the variable speed compressor 22 is represented generally by a low speed and a high speed, with the reference value changing linearly or some non-linear function between the low and high speeds associated with a respective ambient air temperature.

The reference value of a parameter may be determined via an algorithm run by the controller 52 that calculates the reference value when provided with the operating conditions, or alternatively, may be in the form of a single or multi-dimensional lookup table accessible by the controller 52, or some combination of all of these.

In an embodiment, the reference value of the parameter may be adjusted as the operating conditions of the heat pump 20 deviate from the conditions when the reference value of the parameter was obtained. Examples of changes in operating conditions include changes in ambient temperature, and changes in volume flow, such as due to stopping or starting one or more of a plurality of compressors or changing the operating speed of one or more of a plurality of compressors.

The threshold associated with a respective monitored parameter may be derived from the reference value. In an embodiment, the threshold is determined by applying a percentage reduction to the reference value of the parameter. This reduction percentage may be anywhere from 30% to 98% of the capacity for a second heat exchanger 28 operating at the same conditions with no frost accumulation.

In another embodiment, the threshold is derived from the reference value by applying an offset to the reference value of the parameter. When the parameter is one of the mass flow, the outlet pressure at the second heat exchanger 28, and the inlet pressure at the second heat exchanger 28, the offset may be anywhere from about 2% to about 70% of the reference value of the parameter. When the parameter is the inlet temperature of the second heat exchanger 28, the offset may be anywhere between about 2° F. to about 40° F. Further, when the parameter is the discharge temperature of the air at the second heat exchanger 28, the offset may be anywhere between about 2° F. to about 20° F.

Alternatively, the threshold may be determined by applying a percentage reduction to the offset between the ambient air temperature and the reference air discharge temperature determined for a second heat exchanger 28 operating at the same conditions with no frost accumulation thereon. This reduction percentage may be anywhere from about 2% to about 70% of the offset. For example, if the reduction percentage is chosen to be 50%, and the ambient air temperature was 30° F. and the air discharge temperature was 22° F. for a second heat exchanger 28 operating at the same conditions with no frost accumulation, then the offset is determined as (30° F.-22° F.)×50%=4° F. Applied to the ambient air temperature of 30° F., this offset would produce a threshold of 30° F.-4° F.=26° F. Alternatively, the threshold offset may be applied to the current ambient temperature. For example, if the ambient air temperature was 30° F. resulting in a threshold offset of 4° F. determined for a second heat exchanger 28 operating at the same conditions with no frost accumulation as previously described, and the ambient air temperature decreases to 28° F. during the heating cycle, the offset of 4° F. applied to the current ambient air temperature would produce a threshold of 28° F.-4° F.=24° F.

In yet another embodiment, the threshold value may be determined by applying the desired method (percentage reduction, offset, etc.) to the known characteristics of the second heat exchanger 28 operating with no frost accumulation over the range of expected operating conditions of the second heat exchanger 28. These operating conditions may consist of some or all of ambient temperature, refrigerant vapor volume flow within the second heat exchanger 28 and air flow across the second heat exchanger 28.

Threshold values for all expected combinations of operating conditions can be stored in a manner accessible to the controller 52. The form of such memory may be an algorithm that calculates the reference value and then the respective threshold value when provided with the operating conditions, may be a multi-dimensional lookup table associated with the reference value, or may be some combination thereof.

In an embodiment, the controller 52 is prohibited from initiating operation of the heat pump 20 in the defrost mode under certain operating conditions. For example, operation in a defrost mode may be prohibited for a fixed period of time after at least one compressor 22 of the heat pump 20 has begun operating after being in an idle condition. In such embodiments, the fixed period of time may be between about zero minutes and about fifteen minutes.

Alternatively, or in addition, the controller 52 may be prohibited from initiating operation of the heat pump 20 in the defrost mode based on the cumulative period of time that at least one compressor 22 has been operating in a heating cycle since the previous defrost cycle. This cumulative time is not reset during an idle period when none of the one or more compressors 22 are operational. The defrost mode may be inhibited until the cumulative time reaches a minimum value anywhere from about zero minutes to about sixty minutes, such as fifteen minutes for example.

In an embodiment, the controller 52 may be prohibited from initiating operation of the heat pump 20 in response to the monitored parameter. The monitored parameter may vary rapidly and over a large range during transient operating conditions such that the monitored parameter crosses the corresponding threshold even though frost accumulation on the second heat exchanger 28 has not reached a quantity sufficient to require a defrost cycle. This condition can be detected by monitoring the rate of change of the monitored parameter and preventing initiation in the defrost mode when the rate of change of the monitored parameter indicates that transient operating conditions may be present (see FIG. 9).

In another embodiment, initiation in the defrost mode is prohibited when the rate of change of the monitored parameter rises above a positive threshold or falls below a negative threshold. Further, initiation in the defrost mode may be prohibited when the rate of change of the monitored parameter is between a positive threshold and a negative threshold for a predetermined period of time after the rate of change of the monitored parameter was above the positive threshold or below the negative threshold. In an embodiment, the predetermined period of time is between about zero minutes and about five minutes. In some embodiments, the predetermined period of time is less than about one minute.

The monitored parameter may continue to vary rapidly and over a large range in some conditions when the heat pump 20 is not operating as desired. Such conditions may occur as a result of too much or too little refrigerant charge in the system, a restriction in flow of refrigerant somewhere in the system, or numerous other potential causes. While this manner of operation is not preferred, it may still provide heating at or near the intended capacity. As such, the second heat exchanger 28 may accumulate frost in a manner similar to that of normal operation. In this condition, the decision to inhibit initiation in the defrost mode due to transient conditions may continue indefinitely, which will result in excessive frost accumulation on the second heat exchanger 28 and an inability of the heat pump 20 to provide the desired heating capacity. To address such operating conditions, a maximum time limit that a decision to initiate a defrost cycle is prohibited may be implemented.

Figure 9:
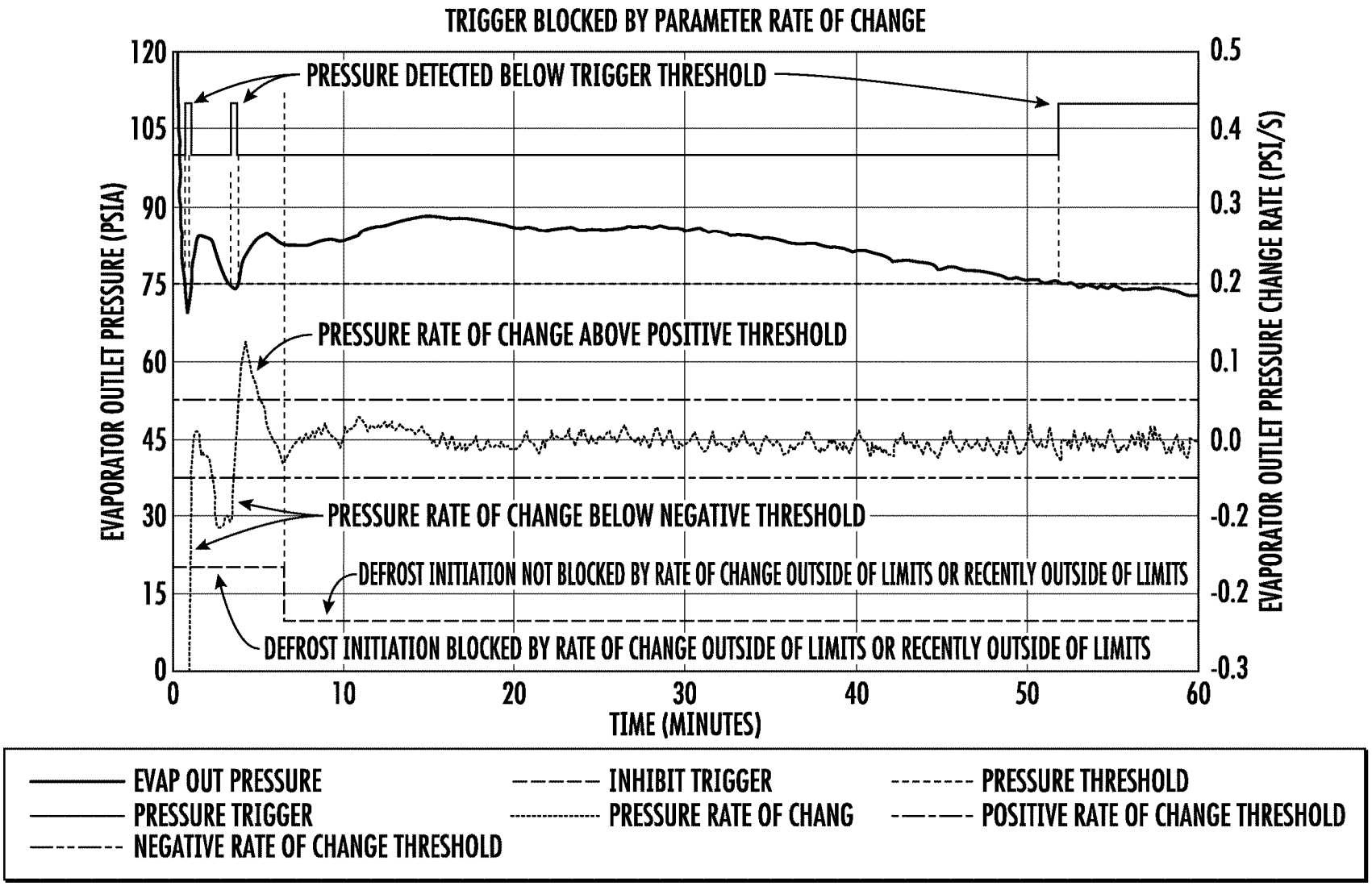
FIG. 9 is a graph comparing evaporator outlet pressure and a rate of change of evaporator outlet pressure relative to a plurality of thresholds during operation in a heating mode according to an embodiment.

With reference now to FIG. 9, the graph represents an example of a system when initiation in a defrost mode of operation is prohibited based on the rate of change of a parameter as described above. In the example provided, the parameter being monitored is the pressure at the outlet of the evaporator. The pressure at the outlet of the v, labeled Evap Out Pressure, is plotted against the scale of the vertical axis at the left side of the graph. Starting at minute zero in the graph, the pressure at the evaporator outlet decreases rapidly from a high value, oscillates briefly in the range of 70 and 85 psia and then achieves an approximately steady state value at about minute 7 in the graph. The Pressure Threshold is represented by a line at of 75 psia.

The Pressure Trigger parameter shown on the graph does not relate to the values shown on either vertical axis. The Pressure Trigger shows a high value to indicate defrost initiation conditions are met when pressure is below the threshold, and a low value to indicate defrost initiation conditions are not met when pressure is above the threshold. The desired initiation of defrost occurs at minute fifty two on the graph. However, the pressure dropping below the threshold briefly at minutes one and three of the graph may also cause defrost to be initiated frost has accumulated on the second heat exchanger 28.

With continued reference to FIG. 9, the graph includes a line representing the Pressure Rate of Change derived from the pressure at the outlet of the second heat exchanger 28. This parameter is plotted against the vertical axis on the right side of the graph. Also shown is a line representing a Positive Rate of Change Threshold having a value of 0.05 psi/s and a line representing a Negative Rate of Change Threshold with a value of −0.05 psi/s. The Inhibit Trigger parameter shown on the graph does not relate to values shown on either vertical axis. The Inhibit Trigger shows a high value to indicate that initiation conditions should be blocked due to the Pressure Rate of Change being above the positive threshold, below the negative threshold, or within a minimum time of either of the foregoing being true. The Inhibit Trigger shows a low value to indicate that initiation conditions should not be blocked due to the Pressure Rate of Change being below the positive threshold and above the negative threshold continuously for a minimum amount of time. As shown, the Inhibit Trigger parameter can be used to block initiation of defrost before minute seven of the graph thereby avoiding an undesired initiation of defrost as a result of the oscillation of the pressure at the outlet of the second heat exchanger 28 falling below the threshold before minute seven.

In an embodiment, the controller 52 has a limit with respect to the continuous length of time that initiation of operation in a defrost mode can be prohibited. This limit may be a maximum amount of continuous time, such as anywhere from about 30 seconds to about 2 hours. After the decision to inhibit initiation of defrost persists for the maximum amount of time, the controller 52 will be able to transition to operation in the defrost mode. In an embodiment, once the maximum amount of continuous time has passed, prohibition of operation of the heat pump 20 in the defrost mode is blocked for a minimum period of time allowing defrost to occur. The period of time that prohibition of operation in the defrost mode is blocked may be anywhere between about thirty seconds and about thirty minutes for example.

Figure 10:
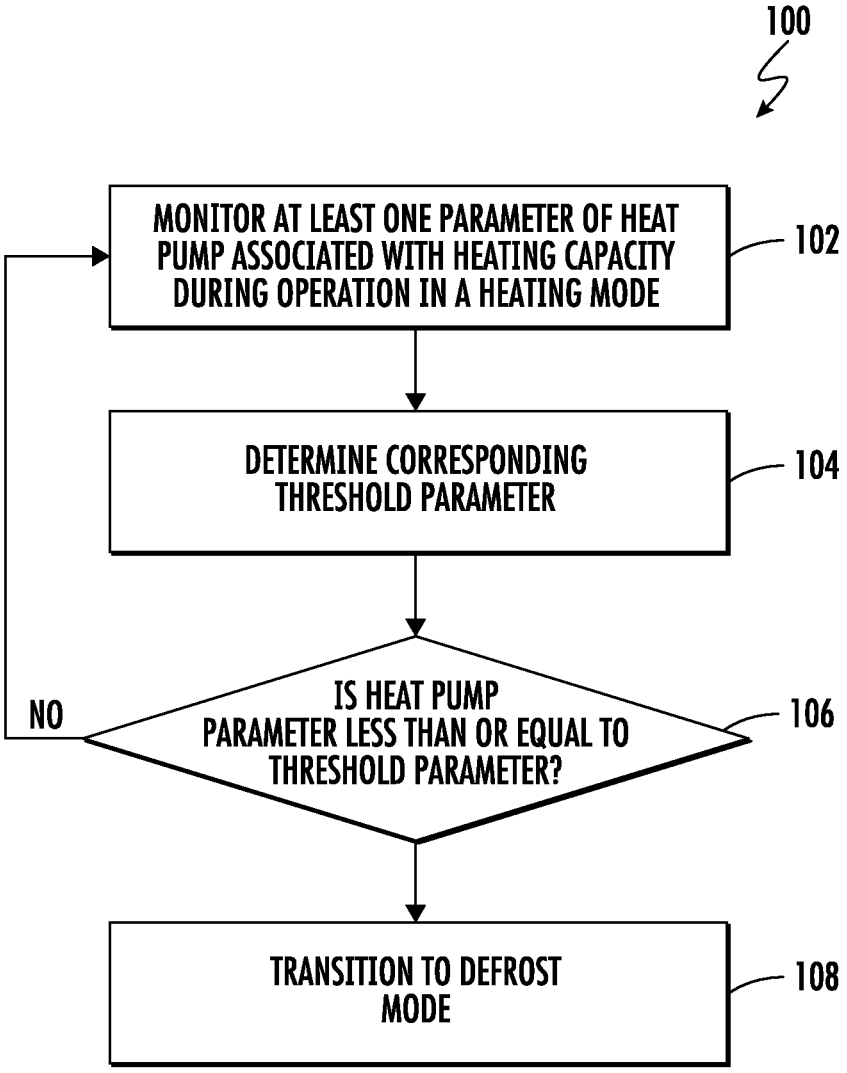
FIG. 10 is a flowchart of an exemplary method of controlling operation of a heat pump in a heating mode in response to detection of a reduced heating capacity of the heat pump according to an embodiment.

With reference now to FIG. 10, a flowchart of a method 100 for controlling operation of a heat pump 20 in a heating mode in response to detection of a reduced heating capacity of the heat pump 20 is illustrated. During operation of the heat pump 20 in the heating mode, in block 102, the controller 52 monitors at least one parameter or operating condition of the heat pump 20 via sensor S. As previously mentioned, examples of suitable parameters or operating conditions include, but are not limited to the refrigerant mass flow, the pressure at the outlet of the second heat exchanger 28, the temperature and/or pressure at an outlet of the expansion valve 26, or the temperature of the air discharged from the second heat exchanger 28 for example. In block 104, the controller 52 further identifies a threshold associated with the parameter being monitored. In an embodiment, to identify the threshold, the controller 52 first identifies a reference value, and then applies an adjustment to the reference value to achieve the threshold. As previously described, the reference value may be determined by observing operation in known frost-free conditions or may be determined by applying operating conditions to an algorithm or a look-up table accessible by the controller 52. The threshold value may be determined by applying a reduction factor or offset to the reference value, or may be determined directly by applying operating conditions to an algorithm or lookup table accessible by the controller 52. In block 106, the monitored parameter of the heat pump 20 is then compared with the threshold by the controller 52. If the monitored parameter remains above the threshold, the method will return to block 102 and continue monitoring. However, if the monitored parameter crosses the threshold, for example is less than or equal to the threshold, the controller 52 will initiate operation in a defrost mode by switch the reversing valve 42 from the first state to the second state, as shown in block 108.

A heat pump or other HVAC system as described herein optimizes the length of time of operation of the heat pump 20 in a heating mode 20 based on the heating capacity of the heat pump 20. As a result, the heat pump 20 operate more efficiently.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method for determining when to initiate a defrost mode of a heat pump, the method comprising:

monitoring a heating capacity of an evaporator of the heat pump during operation of the heat pump in a heating mode via monitoring at least one parameter or operating condition of the heat pump associated with the heating capacity, wherein monitoring at least one parameter or operating condition of the heat pump associated with the heating capacity includes measuring at least one of a temperature and pressure at an outlet of an expansion device, at an inlet of the evaporator, or at any location between the outlet of the expansion device and the inlet of the evaporator;

determining a threshold associated with the heating capacity, wherein determining the threshold includes identifying a reference value associated with the at least one parameter or operating condition and deriving the threshold from the reference value by applying an offset to the reference valve, the offset being based on the at least one parameter or operating condition being monitored; and initiating a defrost mode when the heating capacity of the evaporator is less than or equal to the threshold.

2. The method of claim 1, wherein the parameter or operating condition is a refrigerant mass flow.

3. The method of claim 1, wherein the at least one parameter or operating condition comprises at least one of a pressure at an outlet of the evaporator, a pressure at an inlet of a compressor arranged directly downstream from the evaporator relative to a fluid flow through the heat pump in the heating mode, and a pressure between the outlet of the evaporator and the inlet of the compressor.

4. The method of claim 1, wherein the at least one parameter or operating condition comprises at least one of a pressure at an inlet of the evaporator, a pressure at an outlet of an expansion device, the expansion device being arranged directly upstream from the evaporator relative to a fluid flow through the heat pump in the heating mode, and a pressure between an outlet of the expansion device and the inlet of the evaporator.

5. The method of claim 1, wherein the at least one parameter or operating condition comprises a temperature at an outlet of an expansion device, the expansion device being arranged directly upstream from the evaporator relative to a fluid flow through the heat pump in the heating mode.

6. The method of claim 1, wherein the at least one parameter or operating condition comprises a temperature of an air discharged from the evaporator.

7. The method of claim 1, wherein identifying the reference value further comprises measuring a parameter or operating condition of the heat pump associated with the heating capacity when the evaporator is free of frost.

8. The method of claim 7, wherein the evaporator is free of frost at a beginning of the heating cycle.

9. The method of claim 1, wherein identifying the reference value further comprises looking up the reference value in a table.

10. The method of claim 1, further comprising adjusting the reference value to compensate for changes in one or more operating conditions of the heat pump during the heating mode.

11. The method of claim 1, further comprising prohibiting initiation in the defrost mode in response to a cumulative time of operation of a compressor of the heat pump since operation of the heat pump in the defrost mode being less than a minimum time.

12. The method of claim 1, further comprising prohibiting initiation in the defrost mode for a fixed period of time once a compressor of the heat pump being operated after being in an idle condition.

13. The method of claim 1, further comprising prohibiting initiation in the defrost mode when a rate of change of the parameter or operating condition indicates transient operating conditions.

14. The method of claim 1, further comprising prohibiting initiation in the defrost mode when a rate of change of the parameter or operating condition exceeds a positive threshold or falls below a negative threshold.

15. The method of claim 1, further comprising prohibiting initiation in the defrost mode when a rate of change of the parameter or operating condition is between a positive threshold and a negative threshold for less than a threshold period of time after the rate of change of the parameter was either above the positive threshold or below the negative threshold.

16. A system for conditioning air comprising:

a refrigeration circuit including a compressor, and expansion valve, and a heat exchanger;

a controller configured to:

monitor a heating capacity of the system during operation in a heating mode via monitoring at least one parameter or operating condition of the heat pump associated with the heating capacity, wherein monitoring at least one parameter or operating condition of the heat pump associated with the heating capacity includes measuring at least one of a temperature and pressure at an outlet of an expansion device, at an inlet of the evaporator, or at any location between the outlet of the expansion device and the inlet of the evaporator;

determine a threshold associated with the heating capacity by identifying a reference value associated with the at least one parameter or operating condition and deriving, via a controller, the threshold from the reference value by applying an offset to the reference valve, the offset being based on the at least one parameter or operating condition being monitored; and initiate operation in a defrost mode when the heating capacity of the heat exchanger is less than or equal to the threshold.

17. The system of claim 16, further comprising at least one sensor operably coupled to the controller, the sensor being configured to monitor at least one parameter or operating condition of the heat pump associated with the heating capacity.

* * * * *